US009441817B2

(12) United States Patent
Chiu et al.

(10) Patent No.: US 9,441,817 B2
(45) Date of Patent: Sep. 13, 2016

(54) LIGHT-EMITTING STRUCTURE

(71) Applicants: LITE-ON ELECTRONICS (GUANGZHOU) LIMITED, Guangzhou (CN); LITE-ON TECHNOLOGY CORPORATION, Taipei (TW)

(72) Inventors: Kuo-Ming Chiu, New Taipei (TW); Meng-Sung Chou, New Taipei (TW); Chen-Hsiu Lin, New Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 133 days.

(21) Appl. No.: 14/474,449

(22) Filed: Sep. 2, 2014

(65) Prior Publication Data

US 2015/0117033 A1 Apr. 30, 2015

(30) Foreign Application Priority Data

Oct. 30, 2013 (CN) ..... 2013 1 0526939

(51) Int. Cl.

| | |
|---|---|
| ***F21S 4/00*** | (2016.01) |
| ***F21V 21/00*** | (2006.01) |
| ***F21V 19/00*** | (2006.01) |
| *F21Y 101/02* | (2006.01) |
| *F21Y 105/00* | (2016.01) |

(52) U.S. Cl.
CPC ..... *F21V 19/0055* (2013.01); *F21Y 2101/02* (2013.01); *F21Y 2105/001* (2013.01)

(58) Field of Classification Search
CPC ..... F21V 19/0055
USPC ..... 362/249.02–249.04
See application file for complete search history.

(56) References Cited

U.S. PATENT DOCUMENTS

| | | | | |
|---|---|---|---|---|
| 7,182,627 | B1 * | 2/2007 | Huang | F21K 9/00 362/800 |
| 7,883,240 | B2 * | 2/2011 | Lee | F21K 9/00 362/249.02 |
| 2008/0217633 | A1 * | 9/2008 | Chang | H01L 33/507 257/98 |
| 2012/0250310 | A1 * | 10/2012 | Hussell | H01L 25/0753 362/235 |

* cited by examiner

*Primary Examiner* — Jason Moon Han
(74) *Attorney, Agent, or Firm* — Li & Cai Intellectual Property (USA) Office

(57) ABSTRACT

A light-emitting structure comprises a carrier, a light-emitting diode package, and a fixing module. The light-emitting diode package comprises a brittle substrate and a light-emitting unit. The brittle substrate is disposed on the carrier and the light-emitting unit is disposed on the brittle substrate. The fixing module comprises at least two screw units and at least two elastic members which sleeve the screw unit respectively. Each of screw units is screwed onto the carrier and applies a force on the upper surface of the brittle substrate, so as to fasten the brittle substrates to the carrier. Each of elastic members is disposed between the respective screw unit and the carrier, so as to adjust the force from the screw unit.

19 Claims, 13 Drawing Sheets

LIGHT-EMITTING STRUCTURE

BACKGROUND OF THE INVENTION

1. Field of the Invention

The present disclosure relates to a light-emitting structure; in particular, to a light-emitting structure using a brittle substrate.

2. Description of Related Art

Heat dissipation is a significant problem for light emitting diodes. Improvements to a package structure of light-emitting diodes, disposing light emitting diodes on a metal board having higher coefficient of thermal conductivity, using a cooling fan and a thermal gel are common methods for addressing heat dissipation. In recent years, disposing light emitting diodes on a ceramic substrate is a popular method. Through the heat dissipation property of the ceramic substrate, the efficiency of the heat dissipation is improved for the package structure of the light emitting diodes.

In practice, the ceramic substrate is brittle and fastening the ceramic substrate without fracture is a common problem encountered when fastening the ceramic substrate. A common method for fastening a ceramic substrate is to hold the ceramic substrate with a holding structure surrounding thereof and then fastening the holding structure onto a carrier. However, this method of holding the ceramic substrate with the holding structure is inconvenient due to several reasons. For example, when the ceramic substrates have different dimensions, each of the ceramic substrates requires a specific holding structure such that the cost of the overall structure is increased. Moreover, the light emitted by light emitting diodes may be blocked by the holding structure that surrounds the package structure of the light emitting diodes. Therefore, a skilled person in the art must adjust the angle of light emitted from the package structure of the light emitting diodes.

SUMMARY OF THE INVENTION

The object of the present disclosure is to provide a light-emitting structure which solves the problems that light is blocked by the holding structure and production cost is decreased due to without using the holding structure to hold the ceramic substrate.

The advantage of the present disclosure lies in that the light-emitting structure provided by the present disclosure, through designs of "each of the screw units is screwed onto the carrier and simultaneously applies a force on the upper surfaces of the ceramic substrate and the carrier" and "each of the elastic members is disposed between a respective screw unit and the carrier," adjusts the force applied on the brittle substrate by at least two screw units such that the brittle substrate can be fastened onto the carrier without fracture.

In order to further the understanding regarding the present disclosure, the following embodiments are provided along with illustrations to facilitate the disclosure of the present disclosure.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

[First Embodiment]

Figure 1:
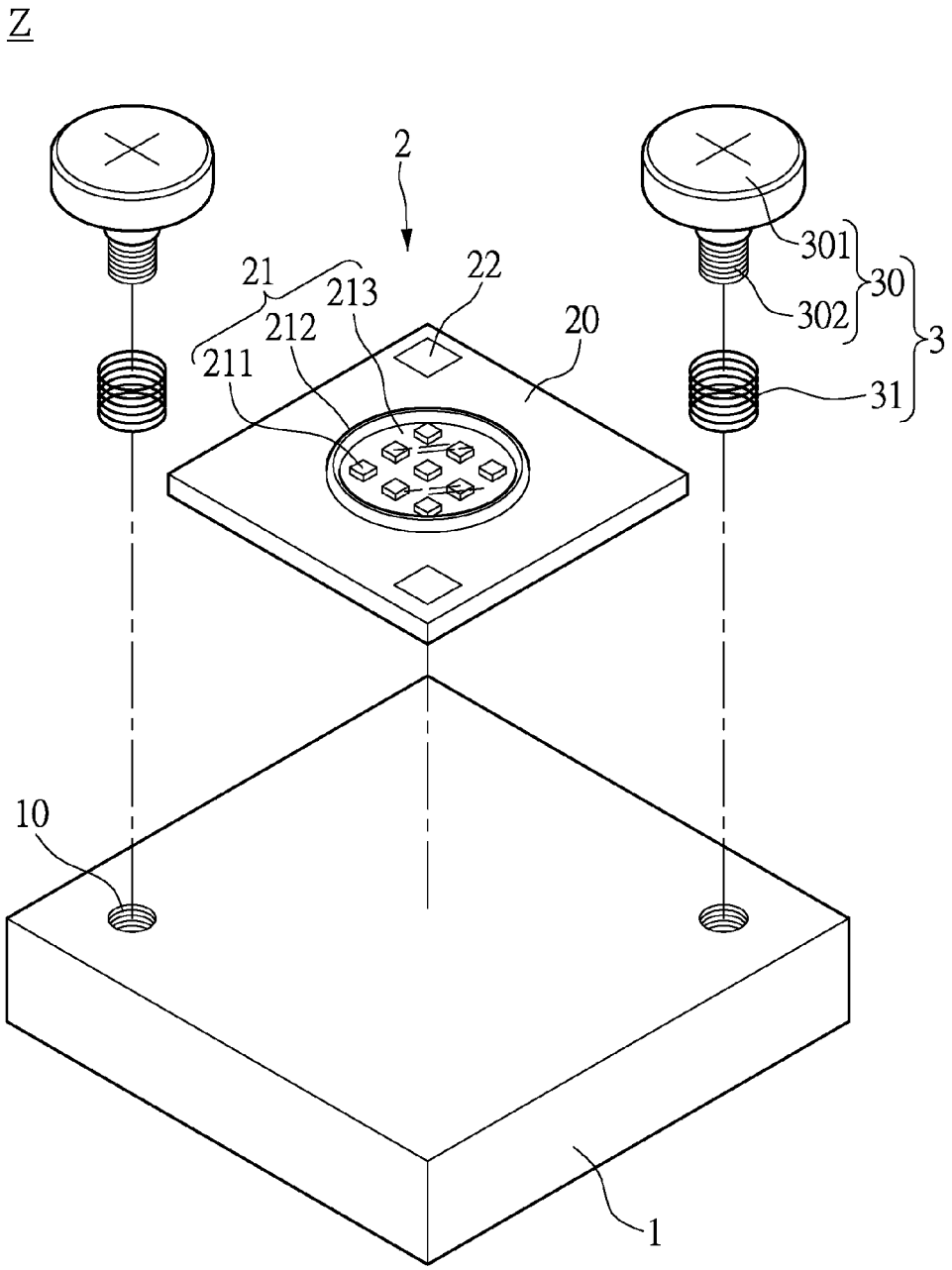
FIG. 1 shows an exploded view of a light-emitting structure according to a first embodiment of the present disclosure.
Figure 2:
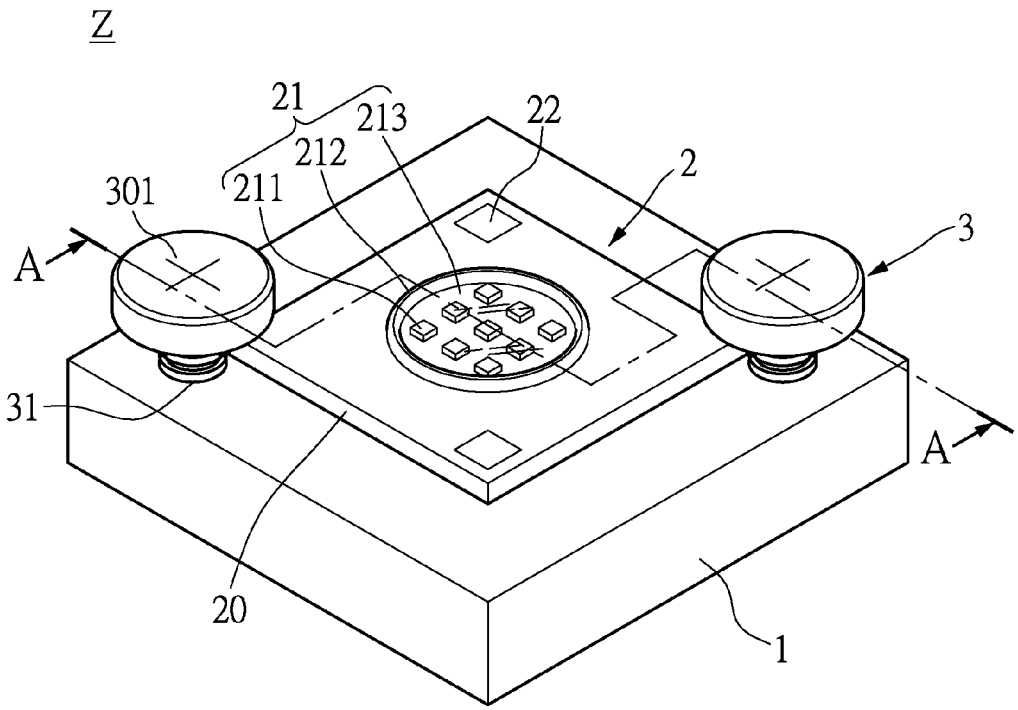
FIG. 2 shows a schematic diagram of an assembled light-emitting structure according to a first embodiment of the present disclosure.
Figure 3:
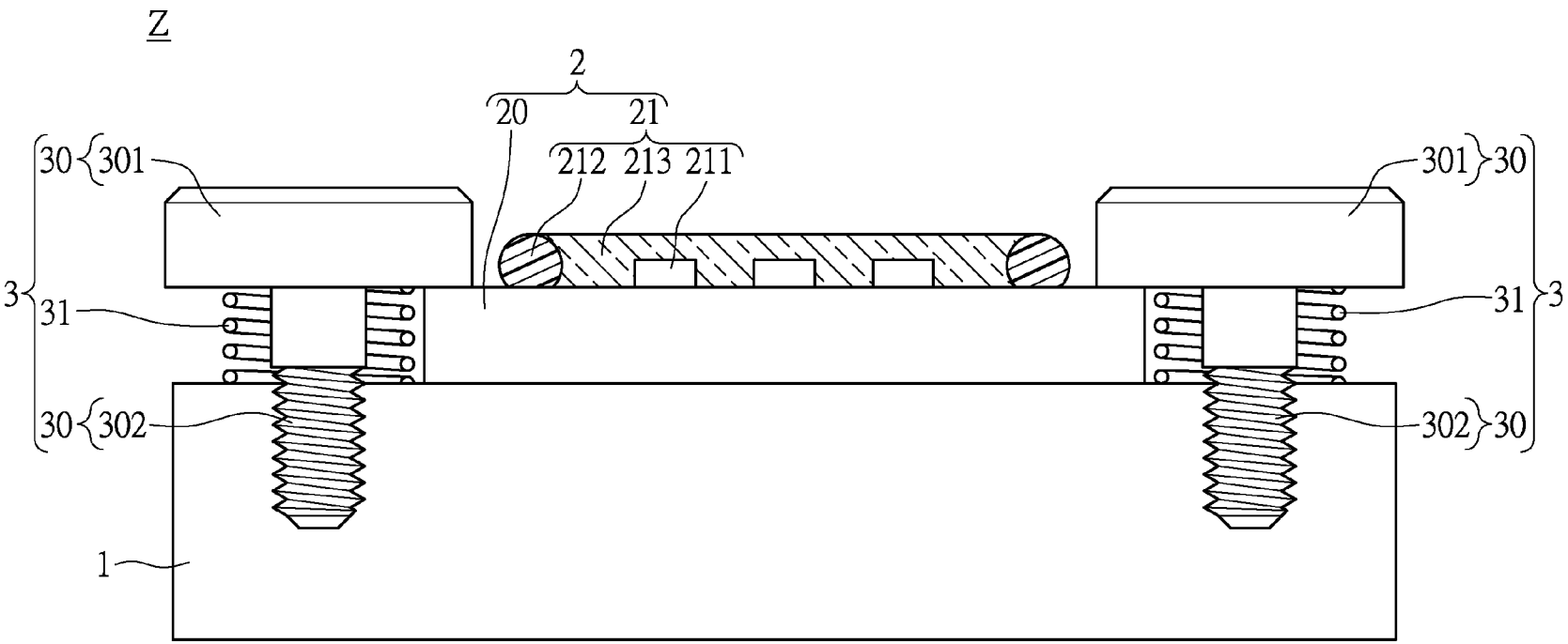
FIG. 3 shows a cross-sectional view along the cutting line A-A of FIG. 2.

FIG. 1 shows an exploded view of a light-emitting structure according to a first embodiment of the present disclosure. FIG. 2 shows a schematic diagram of an assembled light-emitting structure according to a first embodiment of the present disclosure. FIG. 3 shows a cross-sectional view of an assembled light-emitting structure according to a first embodiment of the present disclosure. As shown in FIG. 1 and FIG. 2, a light-emitting structure includes a carrier 1, a light-emitting diode package 2 and a fixing module 3. At least two screw holes 10 are arranged on opposite sides or opposite corners of the carrier 1. The light-emitting diode package 2 at least includes a brittle substrate 20, a light-emitting unit 21 and at least two solder pads 22. The light-emitting unit 21 is disposed on the brittle substrate 20. The two solder pads 22 can be disposed on another opposite corners of the brittle substrate 20 away from the screw holes 10, and be electrically connected to the light-emitting unit 21 for connecting the light-emitting unit 21 to an external power source. Preferably, the brittle substrate 20 is a ceramic substrate, glass substrate, silicon substrate or silicon carbide substrate. The fixing module 3 includes at least two screw units 30 and at least two elastic members 31. Each of the at least two screw units 30 includes a head portion 301 and a thread portion 302. The head portion 301 and the thread portion 302 are integrally formed as one piece. The cross-sectional area of the head portion 301 is greater than that of the thread portion 302. The elastic member 31 can be a coil spring sleeved around a thread portion 302 of the screw unit 30.

In practice, the light-emitting unit 21 can include a plurality of light-emitting diodes 211, an annular frame 212 and an encapsulation body 213. The plurality of light-emitting diodes 211 are disposed on the brittle substrate 20 and are electrically connected to the solder pads 22. The annular frame 212 surrounds the light-emitting diodes 211. The encapsulation body 213 is accommodated within the region encircled by the annular frame 212 and covers the light-emitting diodes 211. The encapsulation body 213 is transparent and can be mixed with fluorescent materials such as fluorescent powder.

As shown in FIG. 2 and FIG. 3, the fixing module 3 fastens the light-emitting diode package 2 on the carrier 1. Specifically, the thread portion 302 of the screw unit 30 is fastened into one of the screw holes 10 of the carrier 1, and the underside of the head portion 301 of the screw unit 30 abuts the upper surface of the brittle substrate 20 so as to directly apply a force on the upper surface of the brittle substrate 20. Furthermore, the two ends of the elastic member 31 respectively abut the head portion 301 of the screw unit 30 and the carrier 1 for adjusting the force provided by the screw unit 30 and applied on the brittle substrate 20 so that the brittle substrate 20 can be securely fastened on the carrier 1.

[Second Embodiment]

Figure 4:
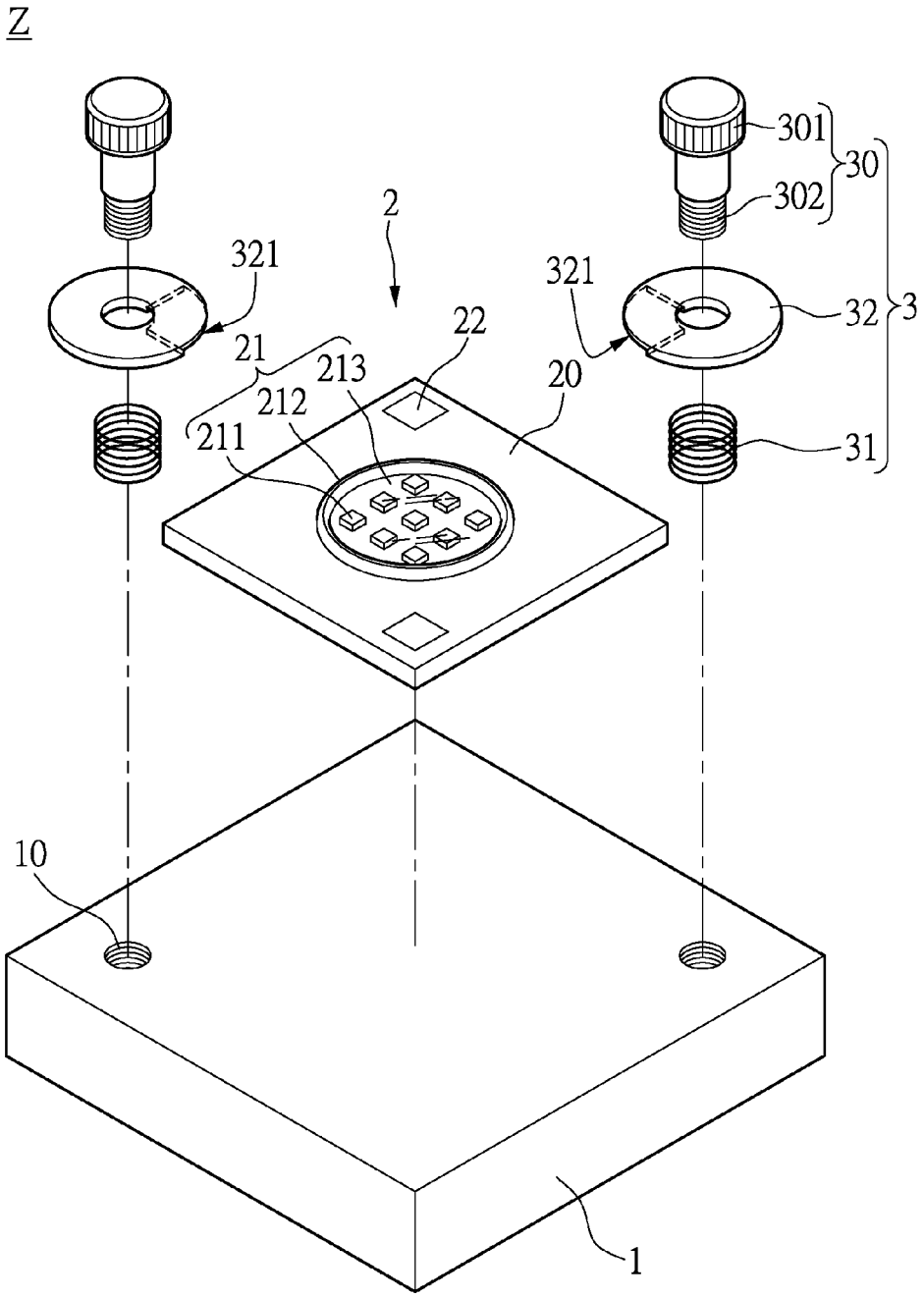
FIG. 4 shows an exploded view of a light-emitting structure according to a second embodiment of the present disclosure.
Figure 5:
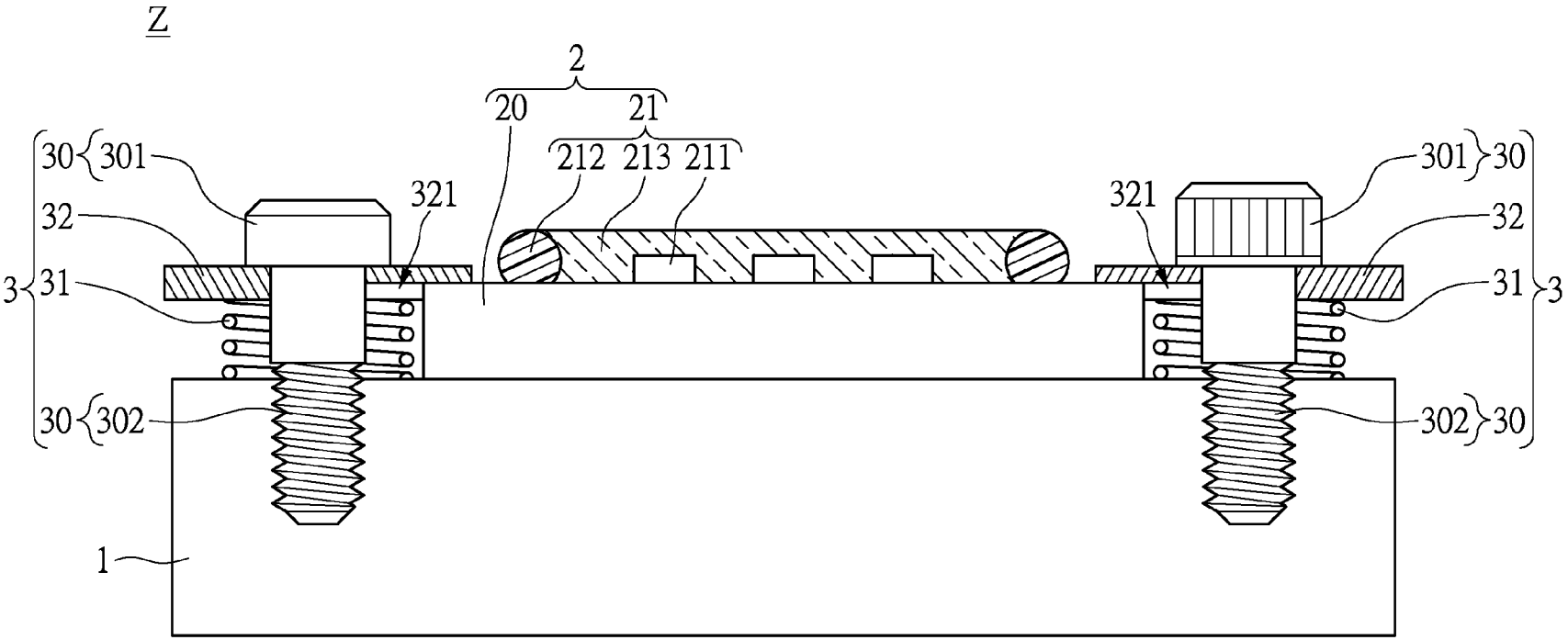
FIG. 5 shows a cross-sectional view of a light-emitting structure according to a second embodiment of the present disclosure.

FIG. 4 shows an exploded view of a light-emitting structure according to a second embodiment of the present disclosure. FIG. 5 shows a cross-sectional view of a light-emitting structure according to a second embodiment of the present disclosure. As shown in the FIGS. 4 and 5, a light-emitting structure Z includes a carrier 1, a light-emitting diode package 2 and a fixing module 3. The detailed description for the carrier 1 and the lighting-emitting package 2 are described in the above embodiment. This embodiment is not mentioned again herein. The main difference between this embodiment and the first embodiment resides in that each of the screw units 30 of the fixing module 3 further can be sleeved by a washer 32. For example, from the overhead perspective, each of the washers 32 can be a circular disc whose area is greater than the area of the underside of the head portion 301 of the screw unit 30, for increasing the contact area between the fixing module 3 and the brittle substrate 20 such that the force applied on the brittle substrate 20 by the fixing module 3 is more evenly spread on the brittle substrate 20 and not overly concentrated resulting in fracturing of the brittle substrate 20. Additionally, the washer 32 has the function of assisting the screw unit 30 to be perpendicularly fastened to the carrier 1 such that the screw unit 30 can effectively apply force on the brittle substrate 20.

In a preferred embodiment, each of the washers 32 has a groove 321. For example, each of the washers 32 can be a circular disc, and each of the grooves 321 occupies a quarter of the circle of the respective washer 32, and the depth of each of the grooves 321 can be half the thickness of each of the washers 32. By this structure, when each of the screw unit 30 is fastened onto the carrier 1, the groove 321 of the respective washer 32 can fittingly engage the brittle substrate 20 and securely abut above the upper surface of the brittle substrate 20

[Third Embodiment]

Figure 6:
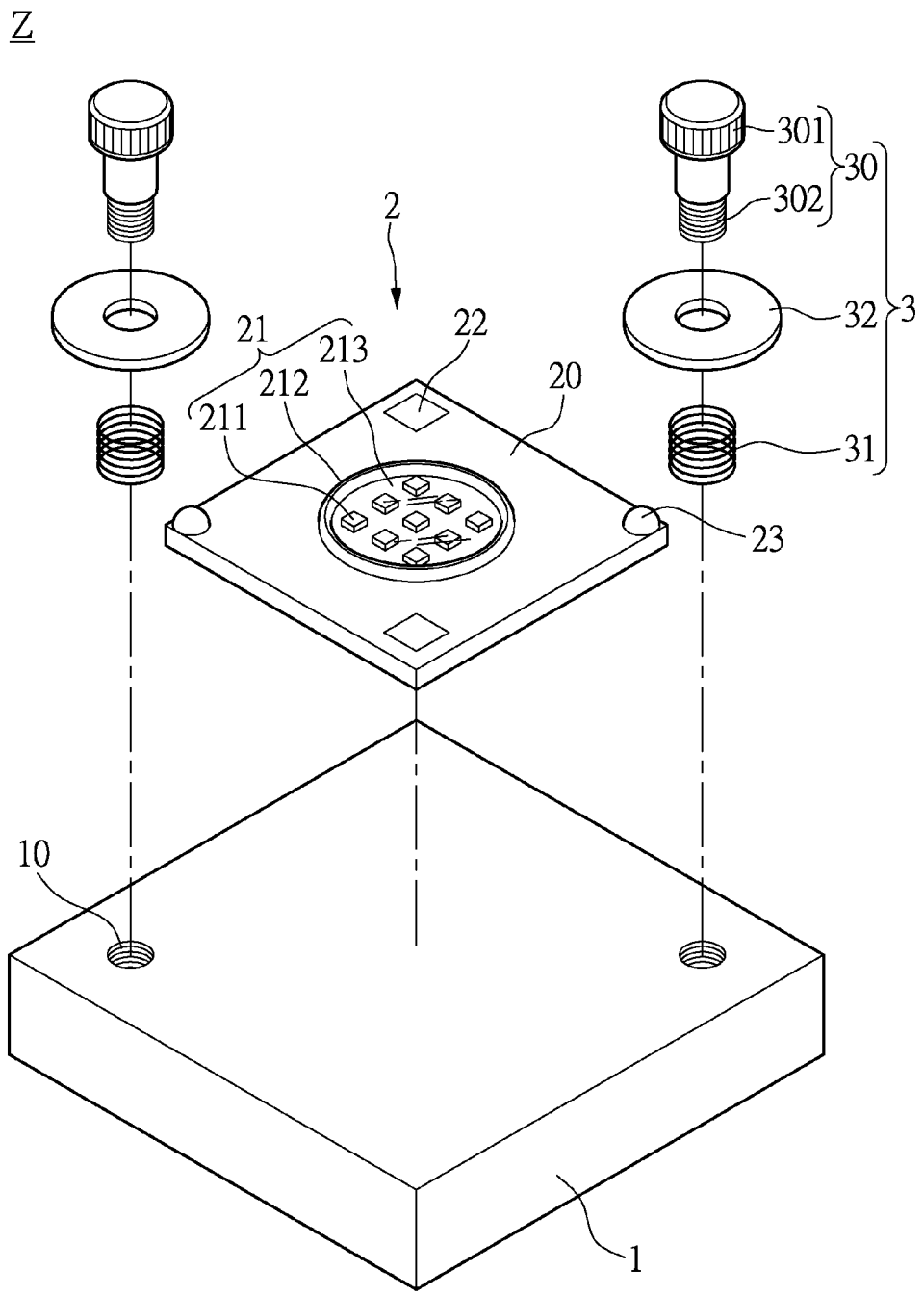
FIG. 6 shows an exploded view of a light-emitting structure according to a third embodiment of the present disclosure.
Figure 7:
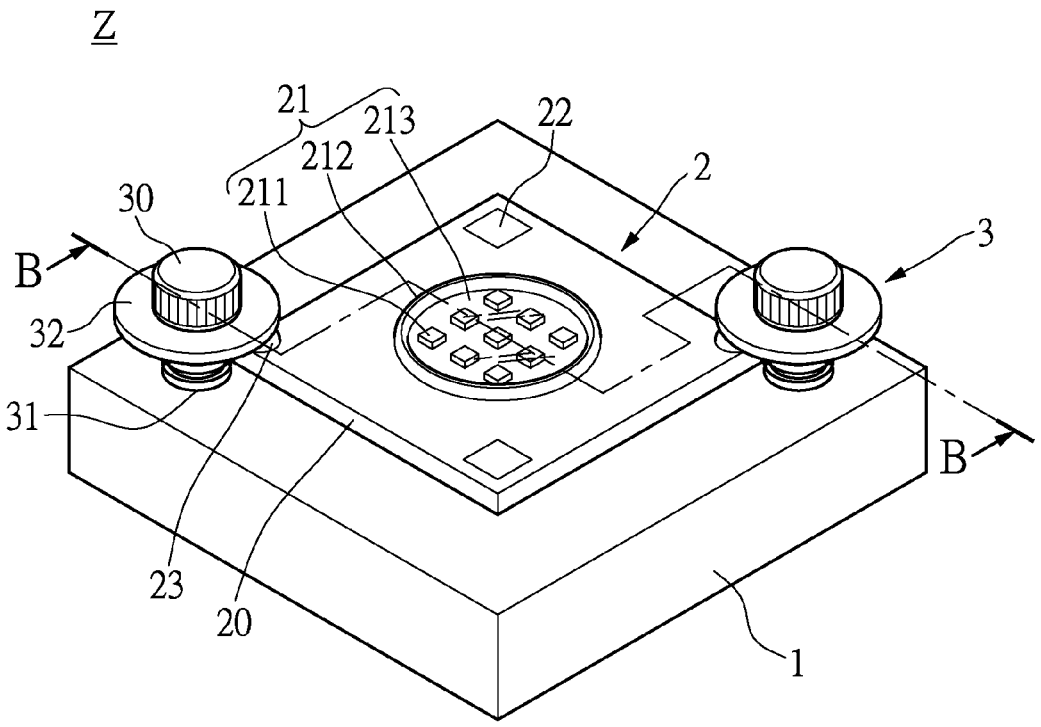
FIG. 7 shows a schematic diagram of an assembled light-emitting structure according to a third embodiment of the present disclosure.
Figure 8:
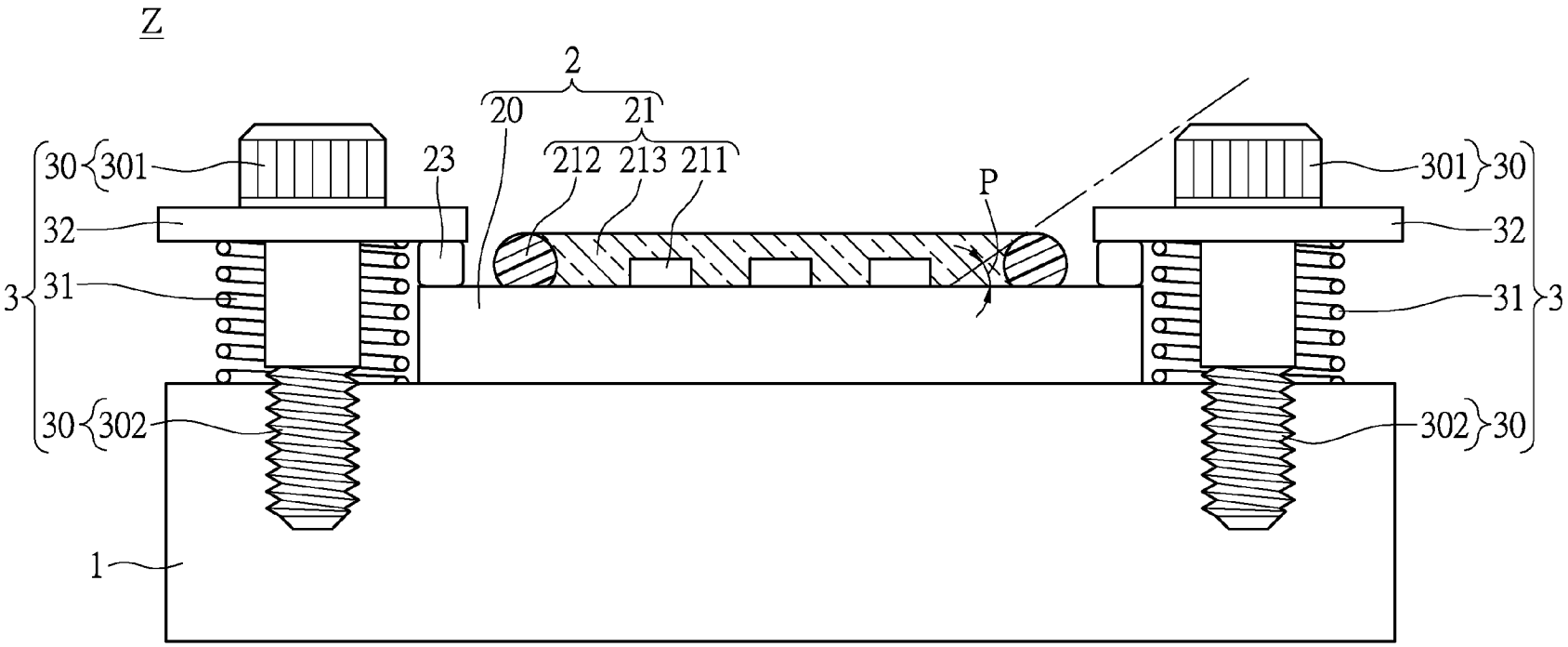
FIG. 8 shows a cross-sectional view along the cutting line B-B of FIG. 7.

FIG. 6 shows an exploded view of a light-emitting structure according to a third embodiment of the present disclosure. FIG. 7 shows a schematic diagram of an assembled light-emitting structure according to a third embodiment of the present disclosure. FIG. 8 shows a cross-sectional view of an assembled light-emitting structure according to a third embodiment of the present disclosure.

As shown in FIG. 6 and FIG. 7, a light-emitting structure Z includes: a carrier 1, a light-emitting diode package 2 and a fixing module 3. The light-emitting diode package 2 includes: a brittle substrate 20, a light-emitting unit 21, at least two solder pads 22 and at least two buffer units 23. The light-emitting unit 21 is disposed on the brittle substrate 20. The buffer units 23 are disposed on opposite corners of the brittle substrate 20 and are respectively proximal to the screw units 30 (or screw holes 10). The two solder pads 22 can be disposed on opposite corners of the brittle substrate 20 away from the buffer units 23, and be electrically connected to the light-emitting unit 21. The brittle substrate 20 is preferably a ceramic substrate. The buffer units 23 can be resin bodies having elastic and light reflecting properties. Of particular note, the material of the annular frame 212 can be the same as the material of the buffer units 23. Therefore, during production process, the annular frame 212 and the buffer units 23 can be disposed on the brittle substrate 20 at the same time by dispensing or molding.

The fixing module 3 includes: a screw unit 30, an elastic member 31 and a washer 32. The screw unit 30 includes a head portion 301 and a thread portion 302. The head portion 301 and the thread portion 302 are integrally formed as one piece. The washer 32 sleeves the thread portion 302 of the screw unit 30 and abuts the head portion 301 of the screw unit 30. The elastic member 31 sleeves the thread portion 302 of the screw unit 30. The two ends of the elastic member 31 respectively abut the washer 32 and the carrier 1. According to practical needs, the washer 32 can be made of metal or plastic.

Specifically, two opposite corners of the carrier 1 each have a screw hole 10. The light-emitting unit 21 is disposed at the center of the brittle substrate 20 of the light-emitting diode package 2. Two opposite corners of the brittle substrate 20 each have a buffer unit 23. The other two opposite corners of the brittle substrate 20 each have a solder pad 22. The brittle substrate 20 is disposed on the carrier 1, and the two buffer units 23 of the light-emitting diode package 2 are proximal to the respective screw holes 10 of the carrier 1. The fixing module 3 includes two screw units 30, each of which is sleeved by a washer 32 and an elastic member 31.

FIG. 8 shows a cross-sectional view along the cutting line B-B of FIG. 7. As shown in the FIG. 8, each of the screw units 30 sleeved by a washer 32 and an elastic member 31 is screwed into the respective screw hole 10 of the carrier 1, for fastening the light-emitting diode package 2 to the carrier 1. Each of the screw units 30 presses downward on the brittle substrate 20 through one of the washers 32 and one of the buffer units 23 for providing a force for fastening the brittle substrate 20 to the carrier 1. The elastic members 31 are respectively disposed between the washers 32 and the carrier 1 for adjusting the force applied to the brittle substrate 20 by the screw units 30.

The solder pads 22 of the brittle substrate 20 fastened to the carrier 1 can supply electric power to the light-emitting diodes 211 through electrically connecting the solder pads 22 of the brittle substrate 20 to external power supply. In a preferred application, the carrier 1 is a metal board having better heat dissipation property, or even better, the carrier 1 is a base having heat dissipation capability, such as a heat sink having multiple fins.

Additionally, in practice, the angle of light emission of the light-emitting diodes 211 of the light-emitting unit 21 is approximately 110-140 degrees. In order to prevent the fixing module 3 from blocking light emitted by the light-emitting diodes 211, the included angle P between the fixing module 3 and the brittle substrate 20 is preferably 20-35 degrees. Specifically, the included-angle line of the included angle P connects extends from the connected line between the top portion of the buffer unit 23 and the top portion of the head portion 301 of the fixing module 3 to the brittle substrate 20.

As mentioned above, the advantage of increasing the contact area between the fixing module 3 and the brittle substrate 20 and the advantage of perpendicularly fastening the screw units 30 to the carrier 1 can be achieved in the present embodiment by means of respectively sleeving the washers 32 around the screw units 30. The advantage of increasing the force applied on the brittle substrate 20 by the fixing module 3 also can be achieved in the present embodiment by means of disposing the buffer units 23 at the contact points between the brittle substrate 20 and the screw units 30. Additionally, after disposing the buffer units 23 on the brittle substrate 20, the problem of loosening of the screw units 30 due to different coefficients of thermal expansion between the brittle substrate 20 and the fixing module 3 is avoided. In other words, after adding the buffer units 23 to the brittle substrate 20, the fixing module 3 can more stably engage the carrier 1.

[Fourth Embodiment]

Figure 9:
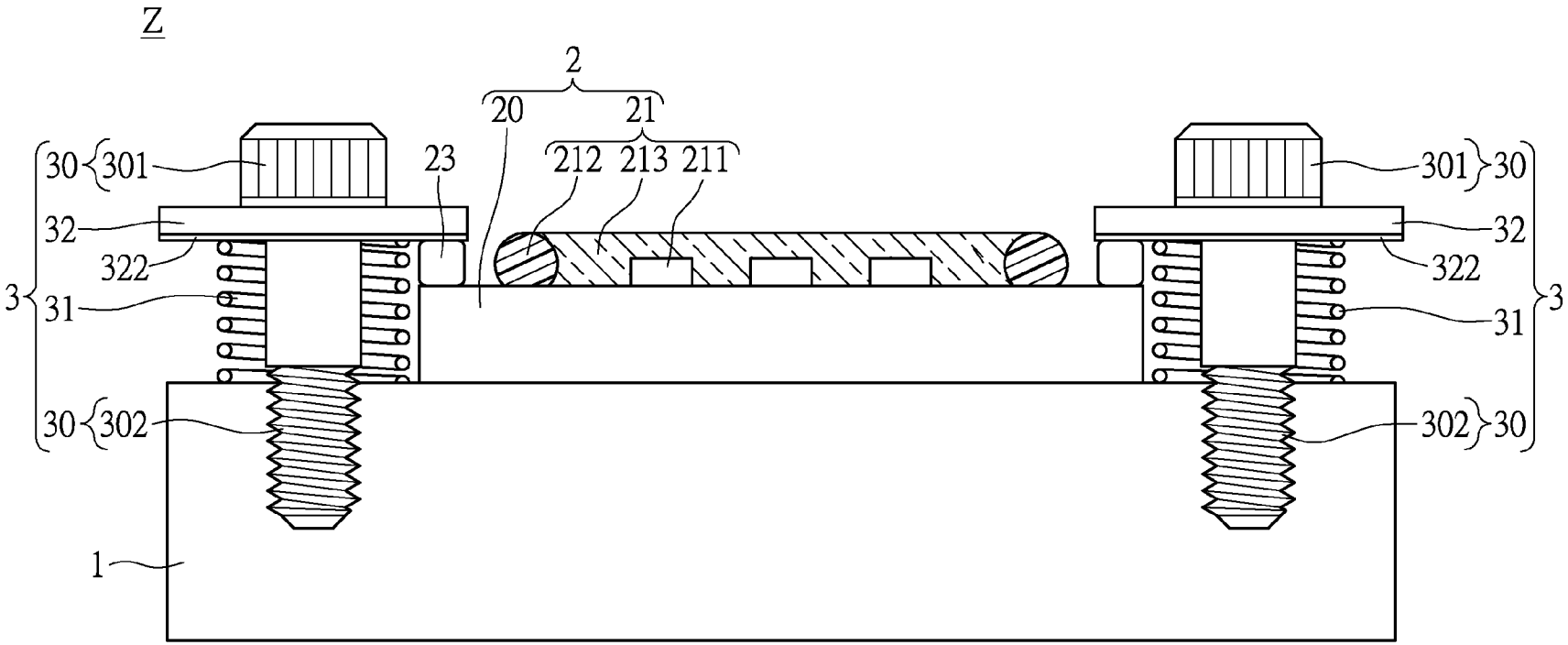
FIG. 9 shows a schematic diagram of a light-emitting structure according to a fourth embodiment of the present disclosure.

FIG. 9 shows a schematic diagram of a light-emitting structure according to a fourth embodiment of the present disclosure. As shown in the figure, a light-emitting structure Z includes: a carrier 1, a light-emitting diode package 2 and a fixing module 3. The relative arrangements of the above components are as described in the above embodiments and are not further detailed herein. The difference between the present embodiment and the above embodiment lies in that the fixing module 3 includes a washer 32 made of a harder material, and further includes a soft padding 322 disposed under the washer 32 and sleeved around the screw unit 30. The soft padding 322 is sandwiched between the washer 32 and the buffer unit 23 so as to prevent the rough surface of the washer 32 made of the harder material from affecting the screw unit 30 to be not perpendicularly fastened on the carrier 1. When the flexural strength of the brittle substrate 20 is fixed, and the material of the elastic member 31 is selected, the soft padding 322 can be simply sleeved for increasing the fastening strength of the screw unit 30 on the brittle substrate 20, so as to prevent an excessive applied force from fracturing the brittle substrate 20.

[Fifth Embodiment]

Figure 10:
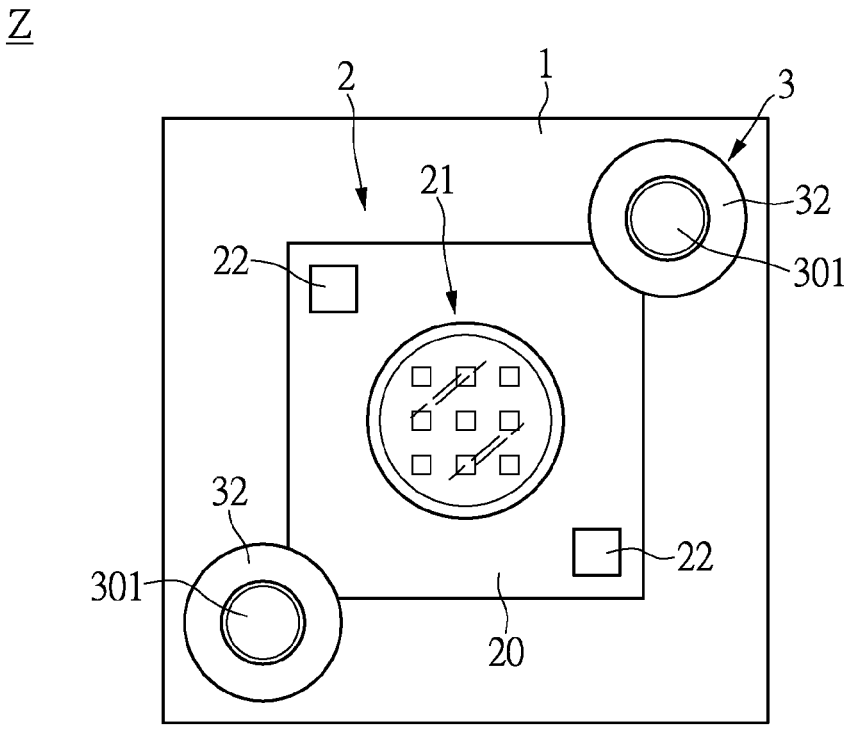
FIG. 10 shows a first schematic diagram of a light-emitting structure according to a fifth embodiment of the present disclosure.
Figure 11:
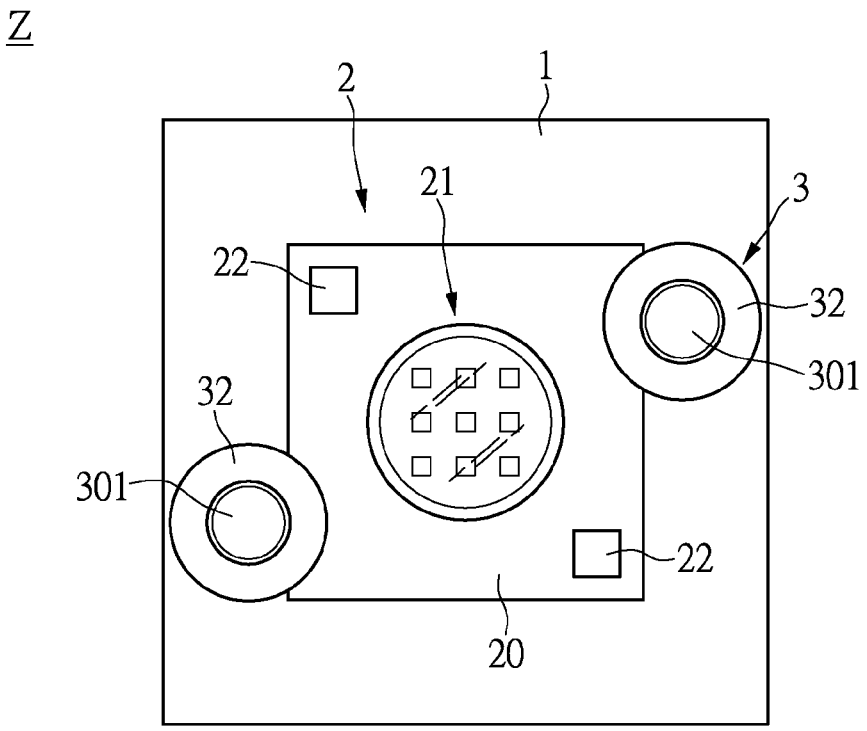
FIG. 11 shows a second schematic diagram of a light-emitting structure according to a fifth embodiment of the present disclosure.
Figure 12:
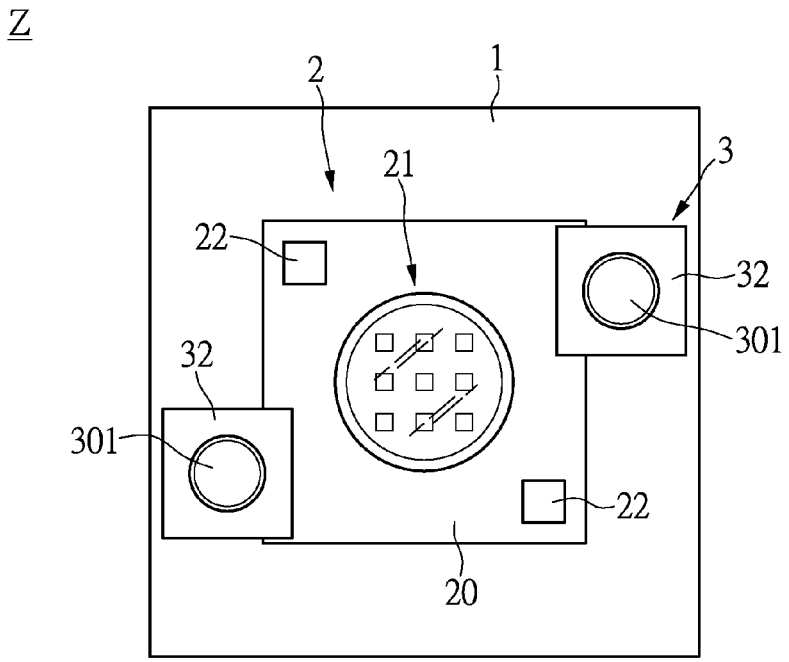
FIG. 12 shows a third schematic diagram of a light-emitting structure according to a fifth embodiment of the present disclosure.

FIG. 10 to FIG. 12 show a light-emitting structure according to a fifth embodiment of the present disclosure. As shown in the FIGS. 10-12, a light-emitting structure Z includes: a carrier 1, a light-emitting diode package 2 and a fixing module 3. The relative arrangements of the above components are as described in the above embodiments and are not further detailed herein. The present embodiment shows that the washer 32 of the fixing module 3 can be designed according to the need and the relative positions between the washer 32 and the brittle substrate 20 of the light-emitting diode package 2 can be modified. As shown in FIG. 10, the shape of the washers 32 of the fixing module 3 can be circular and the washers 32 are disposed on opposite corners of the brittle substrate 20. As shown in FIG. 11, the washers 32 are disposed at two sides of the brittle substrate 20 for increasing the contact area between the washer 32 and the brittle substrate 20, or increasing the contact area between the washer 32 and the buffer unit (not shown in the figure) of the brittle substrate 20. By such design, the force applied on the brittle substrate 20 or the buffer unit can be adjusted or evenly distributed. Additionally, in other applications, the shape of the washers 32 can be rectangular as shown in FIG. 12.

[Sixth Embodiment]

Figure 13:
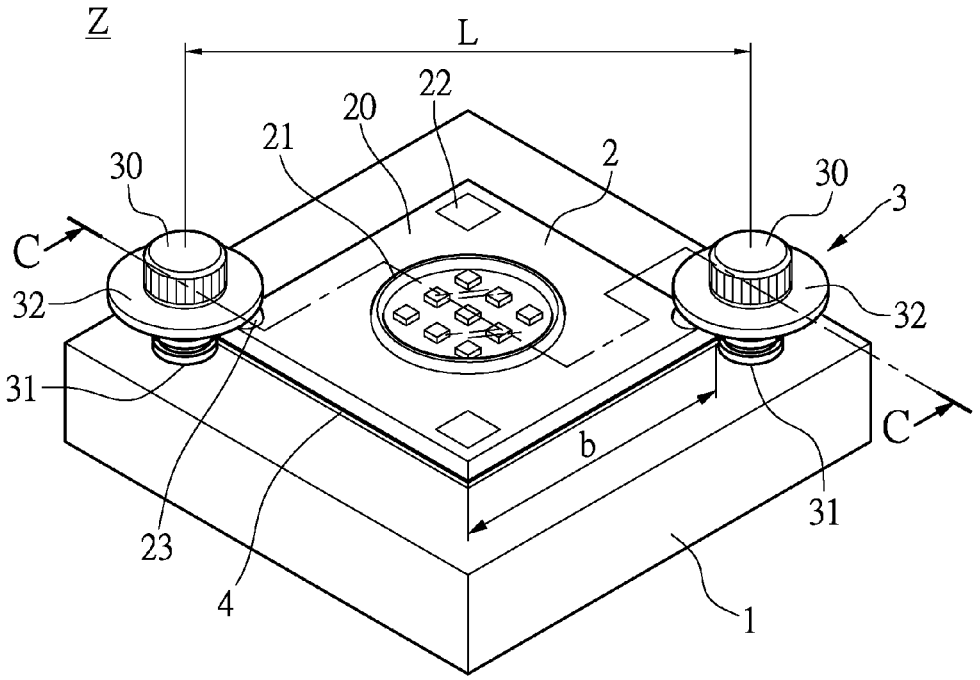
FIG. 13 shows a schematic diagram of an assembled light-emitting structure according to a sixth embodiment of the present disclosure.
Figure 14:
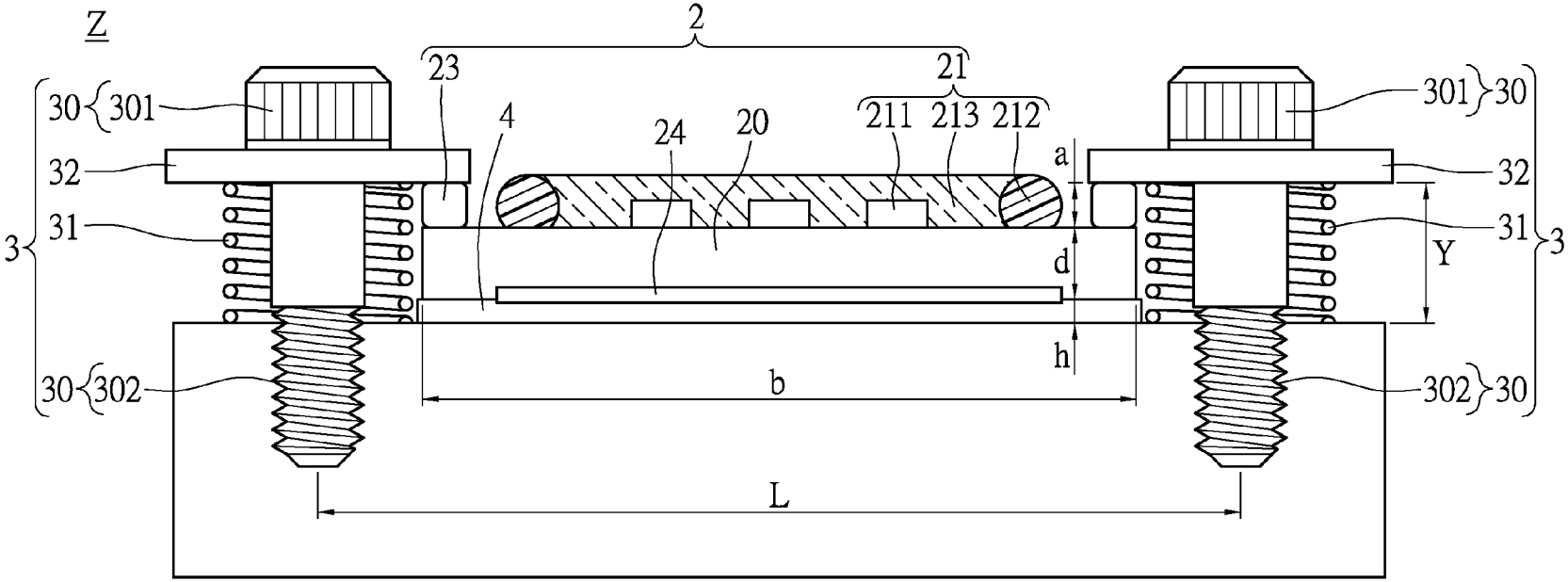
FIG. 14 shows a cross-sectional view along the cutting line C-C of FIG. 13.
Figure 15:
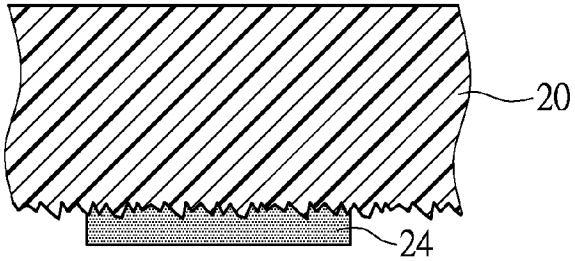
FIG. 15 shows a schematic diagram of a brittle substrate and a thermal conduction layer of a light-emitting structure according to a sixth embodiment of the present disclosure.

FIG. 13 to FIG. 15 show a light-emitting structure according to a sixth embodiment of the present disclosure. As shown in FIG. 13, a light-emitting structure Z includes: a carrier 1, a light-emitting diode package 2, a fixing module 3 and a thermal pad 4. The difference between the present embodiment and the above embodiments lies in that the thermal pad 4 is disposed between the carrier 1 and the light-emitting diode package 2, and the thermal conductive material 24 is embedded at the underside of the brittle substrate 20 between the brittle substrate 20 and the thermal pad 4, for efficiently dissipating heat produced by the light-emitting diode package 2 during operation. In a preferred application, the carrier 1 is made of metal having good heat dissipation properties or has multiple fins for increasing the heat dissipation capability.

Specifically, as shown in FIG. 14 and FIG. 15, the brittle substrate 20 can be a ceramic substrate having multiple micropores thereunder, the thermal conductive material 24 can be an inorganic material, such as a silver adhesive, which can be evenly coated on the ceramic substrate (brittle substrate 20) by printing (e.g. screen printing), for filling in the micropores of the ceramic substrate and cured so that the thermal conductive material 24 becomes a portion of the brittle substrate 20. In practice, the coating area of the thermal conductive material 24 can be greater than the area occupied by the light-emitting unit 21 on the brittle substrate 20 and smaller than the area of the brittle substrate 20. Of particular note, the coating area of the thermal conductive material 24 is not equal to the area of the underside of the brittle substrate 20. By this configuration, when connected light-emitting structures are cut into single light-emitting structures, the thermal conductive materials 24 are not cut and the fractured possibility of the brittle substrate 20 can be decreased.

In other words, the light-emitting unit 21 and the thermal conductive material 24 are respectively disposed at two faces of the brittle substrate 20. In conventional technique, thermal paste is applied on the carrier 1 and then the brittle substrate 20 is disposed thereon. This creates the problem of uneven coating. Furthermore, the brittle substrate 20 is fixed to the carrier 1 after the thermal paste solidifies. The brittle substrate 20 cannot be rearranged when the brittle substrate 20 is positioned incorrectly. On the contrary, in the present disclosure, the thermal conductive material is coated on the underside of the brittle substrate 20 and then the thermal conductive material is cured. After curing, the brittle substrate 20 is arranged on the carrier 1 through the thermal pad 4. Thereby solving the problem of the abovementioned conventional technique. The thermal conductive material 24 fills the micropores of the ceramic substrate to reduce the thermal contact resistance such that the heat from the light-emitting unit 21 can be effectively transmitted to the carrier 1.

Additionally, the cross-sectional view of the light-emitting structure Z shown in FIG. 14 is cut along the C-C line in FIG. 13. In practice of the present embodiment, in order to prevent the brittle substrate 20 from fracturing when fastening the fixing module 3, spring constant of the elastic member 31 satisfies the following formula:

$$K < \frac{2bd^2\sigma}{3L(X-Y)}$$

wherein K is the spring constant of the elastic member 31, b is the width of the brittle substrate 20, d is the thickness of the brittle substrate 20, σ is the flexural strength of the brittle substrate 20, L is the distance between the two screw units 30, X is the original length of the elastic member 31, Y is the length of the elastic member 31 when compressed between the washer 32 of the screw unit 30 and the carrier 1. The length Y of the deformed elastic member 31 satisfies d+h<Y<a+d+h, wherein a is the thickness of the buffer unit 23, d is the thickness of the brittle substrate 20 and h is the thickness of the thermal conductive material 4.

Specifically, the above formula can be derived from the formula used in the three point flexural test:

$$\sigma = \frac{3FL}{2bd^2}$$

As shown in the above formula, L represents the support span (in length), F is the force applied at the middle of the tested beam during the moment of rupture, b is the width of the tested beam, d is the depth of the tested beam, and σ is the flexural strength of the tested beam. Rearranging the above formula obtains the following formula for the maximum amount of force which the beam can support:

$$F = \frac{2bd^2\sigma}{3L}$$

As shown in FIG. 14, applying the above formula to the present disclosure, the brittle substrate 20 is the test beam and F is the maximum force which can be supported by the brittle substrate 20. The two screw units 30 are the support for the test beam and the distance therebetween is the support span. Assuming that the elastic member 31 of the present disclosure obeys Hooke's Law $F_1$=K(X−Y), in order to prevent the brittle substrate 20 from fracturing due to force applied by the screw units 30, the force $F_1$ applied by the elastic member 31 must be smaller than the maximum force F which can be supported by the brittle substrate 20. Therefore the following formula is obtained:

$$K < \frac{2bd^2\sigma}{3L(X-Y)}$$

Of particular note, since the length Y of the deformed elastic member 31 satisfies the formula d+h<Y<a+d+h, when the buffer unit 23 has a greater thickness a, an elastic member 31 having a smaller spring constant K can be selected.

[Seventh Embodiment]

Figure 16:
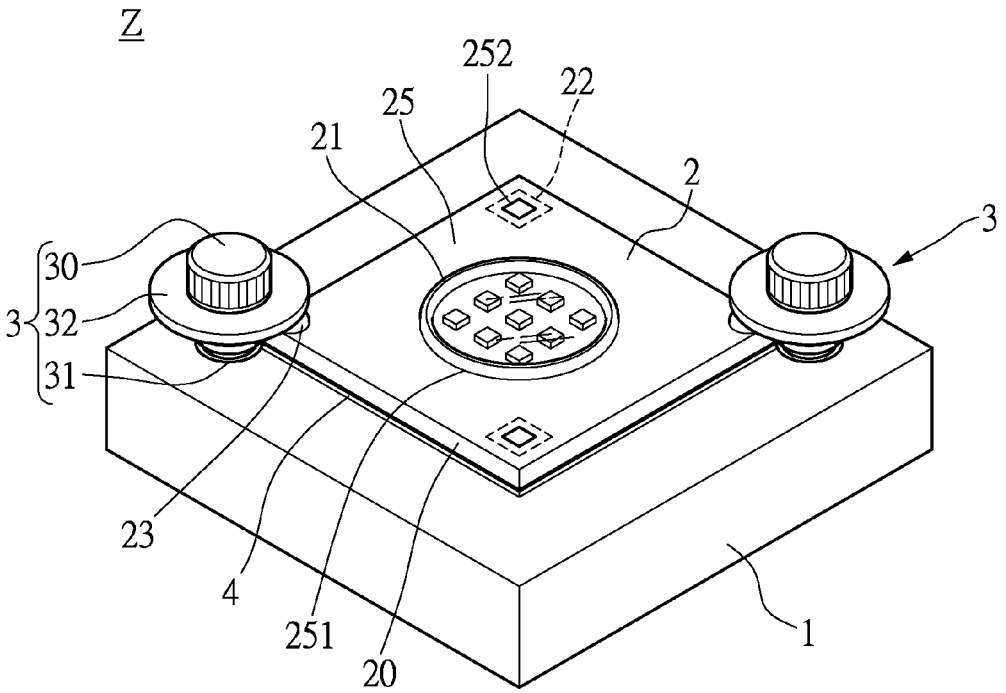
FIG. 16 shows a schematic diagram of a light-emitting structure according to a seventh embodiment of the present disclosure.

FIG. 16 shows a schematic diagram of a light-emitting structure according to a seventh embodiment of the present disclosure. As shown in the FIG. 16, a light-emitting structure Z includes: a carrier 1, a light-emitting diode package 2, a fixing module 3 and a thermal pad 4. The difference between the present embodiment and the above embodiments lies in that a protecting layer 25 is disposed on the surface of the brittle substrate 20 of the light-emitting diode package 2. The protecting layer 25 has a first opening 251 for exposing a chip-mounting area that at least one light-emitting diode of the light-emitting unit 21 is mounted thereon and at least two second openings 252 for exposing the at least two electrodes (preferably solder pads 22) of the light-emitting unit 21. Additionally, in practice, the size of the second openings 252 is smaller than the size of the solder pads 22, such that the protecting layer 25 around the second opening 252 can cover the edge of the solder pads 22 to improve the integration thereof.

Specifically, in practice, the sequence of producing the light-emitting diode package 2 having the protecting layer 25 can be: in first, laying out relevant circuits and solder pads 22 on the brittle substrate 20; then coating or printing a protecting layer 25 (glass gel thin film) having a first opening 251 and two second openings 252 on the brittle substrate 20 with relevant circuit and solder pads 22; then disposing the light-emitting diodes 211 and the annular frame 212 on the brittle substrate; and disposing the encapsulation body 213 within the annular frame 212 in position corresponding to the first opening 251 to encapsulate the light-emitting diodes 211; and finally disposing the buffer units 23 on the protecting layer 25 at opposite corners of the brittle substrate 20.

Alternately, if the annular frame 212 and the buffer units 23 are made of the same material, then the sequence of producing the light-emitting diode package 2 having the protecting layer 25 can be: in first, laying out relevant circuits and solder pads 22 on the brittle substrate 20; then coating or printing the protecting layer 25 (glass gel thin film) having a first opening 251 and two second openings 252 on the brittle substrate 20; then disposing the light-emitting diodes 211 at the first opening 251; then disposing the annular frame 212 and the buffer units 23 at the same time on the brittle substrate 20; and then disposing the encapsulation body 213 within the annular frame 212 in position corresponding to the first opening 251 to encapsulate the light-emitting diodes 211. In a particular embodiment, the protecting layer 25 can be an independent layer to add on the brittle substrate 20.

[Potential Advantages of the Present Disclosure]

In summary of the above, the present disclosure has the following advantages. Buffer units are disposed on the brittle substrate such that the fixing module can abut the buffer units for fastening the brittle substrate to the carrier. At the same time, an elastic member can be disposed between the fixing module and the carrier for increasing the force applied on the carrier by the fixing module and adjusting the force applied on the brittle substrate by the fixing module. This design requires only two fixing modules to securely fasten the brittle substrate to the carrier. Relative to common technique which requires production of another custom-made holding structure, the present disclosure not only saves cost, but is also suitable for brittle substrates of different dimensions.

The fixing module has a relatively small volume, the size of the washers can be selected according to need, and the position of the fixing module can be adjusted, so the brittle substrate can be securely fastened to the carrier without blocking the light emitted by the light-emitting unit. In conventional technique, the design of the holding structure corresponds to the size of the brittle substrate and encircles the entire periphery of the brittle substrate; therefore the problem of blocking light is hard to solved.

A protecting layer is disposed on the upper surface of the brittle substrate of the present disclosure (especially for the ceramic substrates having many micropores), thereby solving the problem of complications in cleaning contaminants which have seeped into the brittle substrate, which happens in conventional technique.

A thermal conductive material is disposed in the micropores of the ceramic substrate of the present disclosure, thereby reducing the thermal contact resistance of the ceramic substrate such that the heat from the light-emitting unit can be effectively transmitted to the carrier for heat dissipation.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A light-emitting structure comprising:

a carrier;

a light-emitting diode package including a brittle substrate disposed on the carrier and a light-emitting unit disposed on the brittle substrate; and a fixing module including at least two screw units and at least two elastic members respectively sleeved on the screw units, wherein the screw units are screwed to the carrier and each of the screw units applies a force on the carrier and the brittle substrate for fastening the brittle substrate to the carrier, each of the elastic members is disposed between the respective screw unit and the carrier for adjusting the force applied on the brittle substrate by the at least two screw units;

wherein a spring constant of the elastic member satisfies the following formula $$K < \frac{2bd^2\sigma}{3L(X-Y)}$$

wherein K is the spring constant of the elastic member, b is a width of the brittle substrate, d is a thickness of the brittle substrate, and σ is a flexural strength of the brittle substrate, L is a distance between the at least two screw units, X is an original length of the elastic member, and Y is a length of the deformed elastic member compressed between the screw unit and the carrier.

2. The light-emitting structure according to claim 1, wherein the light-emitting unit includes at least one light-emitting diode disposed on the brittle substrate, an annular frame disposed on the brittle substrate and encircling the light-emitting diode, and an encapsulation body accommodated within the annular frame and covering the light-emitting diode.

3. The light-emitting structure according to claim 1, wherein the light-emitting unit has at least two solder pads, the light-emitting diode package includes a protecting layer disposed on the brittle substrate, and the protecting layer has a first opening for exposing a chip-mounting area that at least one light-emitting diode is mounted thereon and at least two second openings for exposing the at least two solder pads.

4. The light-emitting structure according to claim 3, wherein the protecting layer partially covers edges of the at least two solder pads.

5. The light-emitting structure according to claim 4, wherein the protecting layer is a thin film made of glass gel.

6. The light-emitting structure according to claim 1, wherein the two screw units of the fixing module are disposed on two opposite corners of the brittle substrate or are disposed on two sides of the brittle substrate.

7. The light-emitting structure according to claim 1, wherein the fixing module further comprises at least two washers respectively sleeved around the two screw units, each of the two screw units presses downward on an upper surface of the brittle substrate through the respective washer for applying the force on the brittle substrate.

8. The light-emitting structure according to claim 7, wherein the two washers are selected from the groups consisting of a harder material and a soft material.

9. The light-emitting structure according to claim 7, wherein each of the two washers has a shape selected from the groups consisting of circular and rectangular.

10. The light-emitting structure according to claim 7, wherein each of the two washers is a circular disc, the circular disc includes a groove thereunder, the groove substantially occupies a quarter circle of the circular disc and half thickness of the circular disc.

11. The light-emitting structure according to claim 1, wherein the light-emitting structure further comprises two buffer units disposed on an upper surface of the brittle substrate, the at least two screw units respectively press downward on the upper surface of the brittle substrate through the at least two buffer units for applying the force on the brittle substrate.

12. The light-emitting structure according to claim 11, wherein the two buffer units are disposed on two opposite corners of the brittle substrate and are respectively proximal to the screw units, and solder pads are disposed on the other two opposite corners of the brittle substrate.

13. The light-emitting structure according to claim 12, wherein the fixing module further comprises at least two washers respectively sleeved on the two screw units, and each of the screw units presses downward on the upper surface of the brittle substrate through the respective washer and the respective buffer unit for applying a force on the brittle substrate.

14. The light-emitting structure according to claim 1, wherein the brittle substrate is a ceramic substrate having a plurality of micropores, and a thermal conductive material at least fills in a portion of the plurality of micropores.

15. The light-emitting structure according to claim 14, wherein the thermal conductive material is embedded at an underside of the brittle substrate, the brittle substrate is disposed on the carrier through a thermal pad, and the brittle substrate having the thermal conductive material thereunder is attached to the thermal pad.

16. The light-emitting structure according to claim 15, wherein an area occupied by the thermal conductive material is smaller than an area occupied by the brittle substrate, and the area occupied by the thermal conductive material is greater than an area occupied by the light-emitting unit.

17. The light-emitting structure according to claim 1, wherein the length of the deformed elastic member satisfies the following formula: $d+h<Y<a+d+h$, wherein a is a thickness of the buffer unit, h is a thickness of the thermal pad, and d is the thickness of the brittle substrate.

18. The light-emitting structure according to claim 1, wherein an included angle between the fixing module and the brittle substrate is twenty to thirty five degrees.

19. The light-emitting structure according to claim 1, wherein each of the at least two screw units includes a head portion and a thread portion, at least two screw holes are arranged on the carrier, the thread portion of each of the screw units is fastened into the respective screw hole of the carrier, and an underside of the head portion of the screw unit abuts an upper surface of the brittle substrate so as to directly apply the force on the upper surface of the brittle substrate.

* * * * *